US005781087A

United States Patent [19]

Milroy et al.

[11] Patent Number: 5,781,087

[45] Date of Patent: Jul. 14, 1998

[54] LOW COST RECTANGULAR WAVEGUIDE ROTARY JOINT HAVING LOW FRICTION SPACER SYSTEM

[75] Inventors: William W. Milroy, Playa del Rey; Shane H. Hunter, Huntington Beach, both of Calif.

[73] Assignee: Raytheon Company, Lexington, Mass.

[21] Appl. No.: 580,400

[22] Filed: Dec. 27, 1995

[51] Int. Cl.[6] ..... H01P 1/06

[52] U.S. Cl. ..... 333/257; 333/261

[58] Field of Search ..... 333/256, 257; 333/261

[56] References Cited

U.S. PATENT DOCUMENTS

| | | | |
|---|---|---|---|
| 2,521,818 | 9/1950 | Aron | 333/257 |
| 2,597,143 | 5/1952 | Aron | 333/257 |
| 2,736,867 | 2/1956 | Montgomery | 333/256 X |
| 2,969,513 | 1/1961 | Brennalt | 333/257 |
| 3,001,159 | 9/1961 | Hilsinger, Jr. | 333/257 |
| 4,625,188 | 11/1986 | Bourgie | 333/257 |

*Primary Examiner*—Benny T. Lee

*Attorney, Agent, or Firm*—Leonard A. Alkov; Glenn H. Lenzen, Jr.

[57] ABSTRACT

A rectangular waveguide rotary joint that allows limited mechanical rotation of two rectangular waveguides around a common longitudinal axis. The joint comprises a first rectangular waveguide having a first waveguide flange and a second rectangular waveguide having a second waveguide flange, wherein the second waveguide flange is disposed adjacent to the first waveguide flange with an air gap disposed therebetween. An RF choke is formed in the waveguide flanges for reducing RF leakage caused by the air gap, and a low friction spacer system for separating the first and second waveguides to maintain relative alignment of the waveguides during rotation and maintain a substantially constant separation between the waveguides. The waveguide rotary joint provides for a low voltage standing wave ratio (VSWR) and low insertion loss exhibited over a +/−30 degree rotation range.

4 Claims, 4 Drawing Sheets

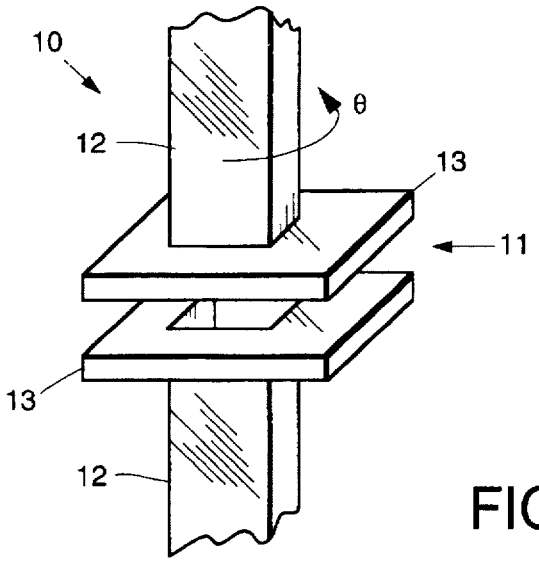
FIG. 1.
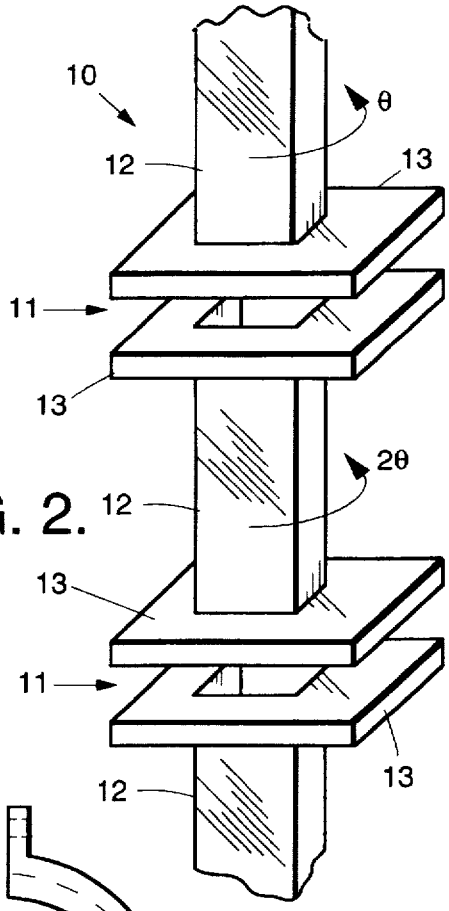
FIG. 2.
FIG. 3.
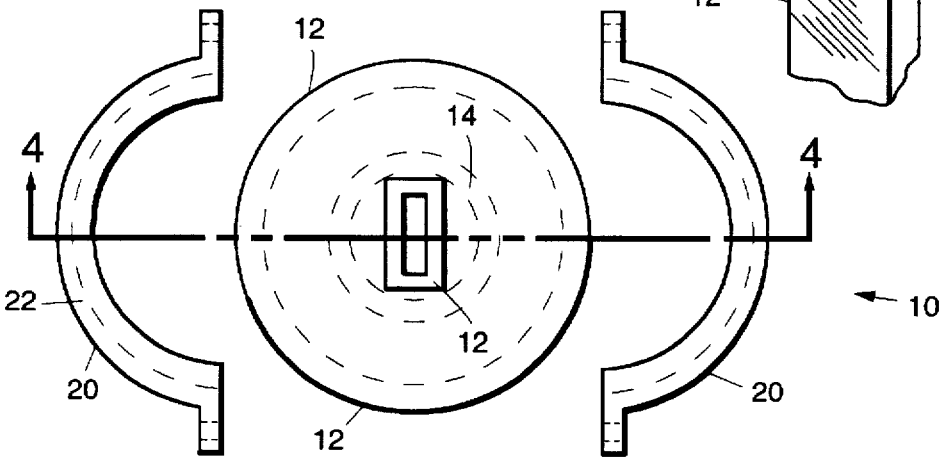
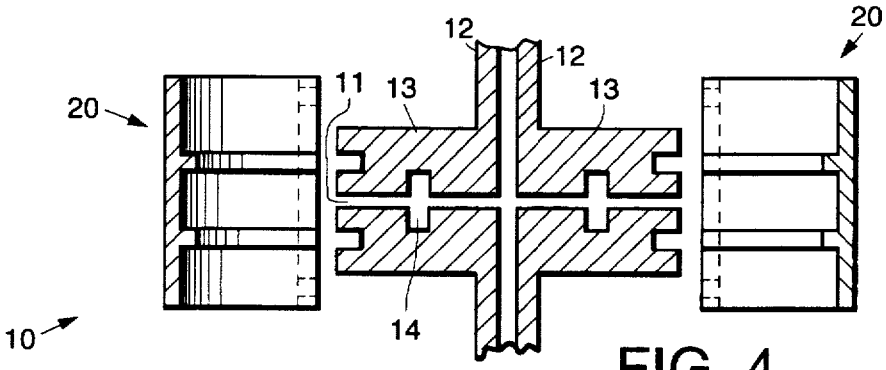
FIG. 4.

LOW COST RECTANGULAR WAVEGUIDE ROTARY JOINT HAVING LOW FRICTION SPACER SYSTEM

BACKGROUND

The present invention relates to rectangular waveguides, and more particularly, to an improved rectangular waveguide rotary joint.

Due to their weight and bulk, it is often impractical to dispose a transmitter and receiver of a microwave system on a moving mass of a mechanically-rotated antenna. However, it is important that an efficient low-loss radio frequency (RF) connection between these stationary apparatus and the rotating antenna be achieved in order to assure adequate overall system performance. A waveguide rotary joint is the highest performance method for achieving this function.

Traditional waveguide rotary joints are somewhat bulky and expensive due to the multiple transitions and mode converters/suppressors required to successfully transition from the dominant rectangular waveguide modes to a non-dominant (somewhat unstable) circular waveguide mode and finally back to rectangular waveguide.

Conventional waveguide rotary joints disposed between two rectangular waveguides generally require full 360 degree rotation. Consequently, the dominant TE10 mode of the rectangular waveguide is inappropriate due to the inherent asymmetry of the field components associated with this mode. In the limiting case of 90 degree (or 270 degree) relative rotation between the two rectangular waveguides, both waveguides are cut-off relative to each other and hence no transmission takes place. For this reason, the TM01 circular waveguide mode is generally selected due to its inherent rotational symmetry (circumferential magnetic fields). Therefore, the rectangular waveguide mode must be transitioned into and out of this circular waveguide mode. Further complicating this arrangement is the fact that the TM01 mode is not the dominant mode in a circular waveguide and therefore care must be taken not to excite the dominant TE11 mode. These transitions and mode complications result in a rotary joint that is narrow-band, relatively lossy, mechanically and electrically complex, and costly. Specifically, conventional rotary joints typically cost $1000 to $1500 each, even in quantities of several thousand units. Typical insertion loss values for these devices span from 1 dB at Ku-band to 1.5 dB at W-band.

Therefore, it is an objective of the present invention to provide for an improved rectangular waveguide rotary joint.

SUMMARY OF THE INVENTION

In order to meet the above and other objectives, the present invention is a low-cost rectangular waveguide rotary joint that is comprised of two short rectangular waveguides, or waveguide sections, aligned along their longitudinal axes. Two opposing circular flanges are separated by a small air gap and a machined RF choke (groove) is disposed in each of the two opposing flange surfaces for suppressing RF leakage through the air gap.

The waveguide rotary joint allows for limited mechanical rotation of the two rectangular waveguides around a common longitudinal axis with low voltage standing wave ratio (VSWR) and low insertion loss exhibited over a +/−30 degree rotation range. The relative simplicity, low-cost, and high performance of the waveguide rotary joint compared to conventional 360 degree-capable joints is significant, and it is therefore a preferable choice for those applications requiring less than or equal to a total 360 degrees of rotational freedom.

In contrast to conventional waveguide rotary joints, the present low-cost rectangular waveguide rotary joint requires no transitions and no mode converters or suppressors. The present rotary joint is extremely simple, mechanically durable, and has unusually low insertion-loss, even at millimeter-wave frequencies. The rectangular waveguide rotary joint requires no transitions and no mode converters/suppressors. Recurring costs less than $100 in even small quantities are achievable. Measured insertion loss values for the low-cost waveguide rotary joint span from 0.2 dB at X-band to 0.5 dB at Ka-band (at up to a +/30 degree rotation range). The flange surfaces of the opposing waveguides are separated by a predetermined finite air gap and hence there is no concern with degradation due to mechanical friction.

The waveguide rotary joint may be employed with all mechanically-scanned antennas not requiring fill 360 degree rotation. Such applications include side-looking reconnaissance radars, hypersonic missile sensors, imaging radars, and automotive applications. The relative low-cost and high-performance benefits of the present rotary joint are especially applicable to commercial, high-quantity military, and all millimeter-wave applications where the cost and dissipative losses of conventional rotary joints may be unacceptable. By symmetry, the present low-cost rotary joint has two available 60 degree rotation ranges about two directions separated by 180 degrees. It is therefore ideal for those specialized applications where it is desirable to use one antenna to service both the starboard and port sides of an aircraft.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which:

FIG. 1 illustrates a rectangular waveguide rotary joint in accordance with the principles of the present invention;

FIG. 2 shows a plurality of cascaded waveguides employing a plurality of joints;

FIG. 3 illustrates a top view of the joint of FIG. 1;

FIG. 4 illustrates a cross-sectional view of the joint of FIG. 1 taken along the lines 4—4 of FIG. 3;

DETAILED DESCRIPTION

Figure 5:
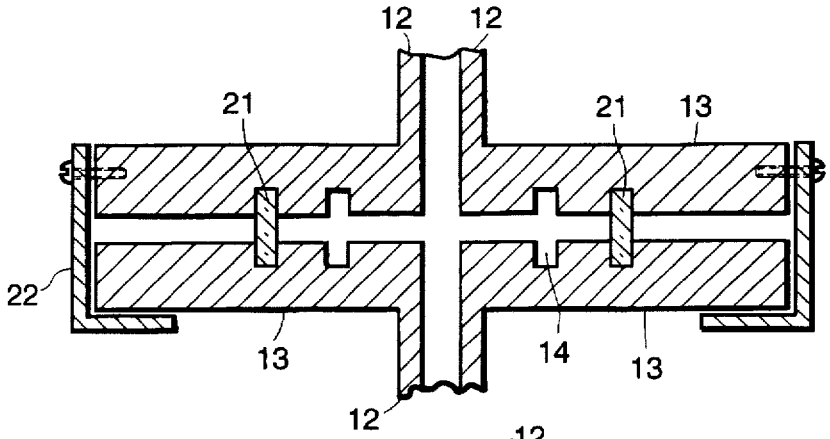
FIG. 5 shows a spacer system comprising a substantially frictionless insert ring.

Referring to the drawing figures, FIG. 1 illustrates a rectangular waveguide rotary joint 10 in accordance with the principles of the present invention. FIG. 2 shows a plurality of cascaded waveguides 12 employing a plurality of joints 10. FIGS. 3 and 4 illustrate top and cross sectional views of the joint 10. With reference to FIG. 1, the rectangular waveguide rotary joint 10 is comprised of two rectangular waveguides 12 aligned along their longitudinal axes, with each waveguide 12 comprising a planar waveguide flange 13. The waveguides 12 are butted end-to-end and a narrow air gap 11 (FIGS. 1,2,4) separates the two planar waveguide flanges 13. An RF choke 14 comprising grooves 14 (FIG. 4) is fabricated in the respective waveguide flanges 13 in order to reduce RF leakage due to the finite separation 11 (air gap) between the flanges 13. The term θ in FIG. 1 indicates that the upper waveguide 12 is rotated by an angle θ with respect to the lower waveguide 12, and thus the term θ is indicative of a rotation angle between the two waveguides 12 of the joint 10. With regard to FIG. 2, the term θ indicates that the upper waveguide 12 is rotated by an angle θ with respect to the lower waveguide 12, and the term 2θ indicates that the center waveguide 12 is rotated by an angle 2θ with respect to the lower waveguide 12. Thus, the terms θ and 2θ are indicative of respective rotation angles between the three waveguides 12 of the joint 10.

With reference to FIGS. 3 and 4, a low friction spacer system 20 is employed to maintain relative alignment of the waveguides 12 during rotation while maintaining a constant minimal separation between the waveguides 12. Low friction is desired in the spacer system 20. Several spacer systems 20 are shown in FIGS. 5 through 8 that may be used in the rotary joint 10. The spacer system 20 is generally comprised of means for securing one of the waveguide flanges 13 and rotational means that permits the other waveguide flange 13 to rotate. As is shown in FIGS. 3 and 4, the low friction spacer system 20 uses ring brackets 22, for example, which are discussed more fully with regard to FIGS. 5–8.

FIG. 5 illustrates a portion of the joint 10 showing the two waveguides 12 and the RF choke 14 (grooves 14), and which has a spacer system 20 comprising a substantially frictionless insert ring 21 that may be comprised of Teflon, for example, and a ring bracket 22 that may be comprised of Teflon, for example. The ring bracket 22 is attached to one planar waveguide flange 13 to keep it from moving while the other planar waveguide flange 13 is free to rotate. The insert ring 21 is disposed between adjacent planar surfaces of the waveguide flanges 13.

Figure 6:
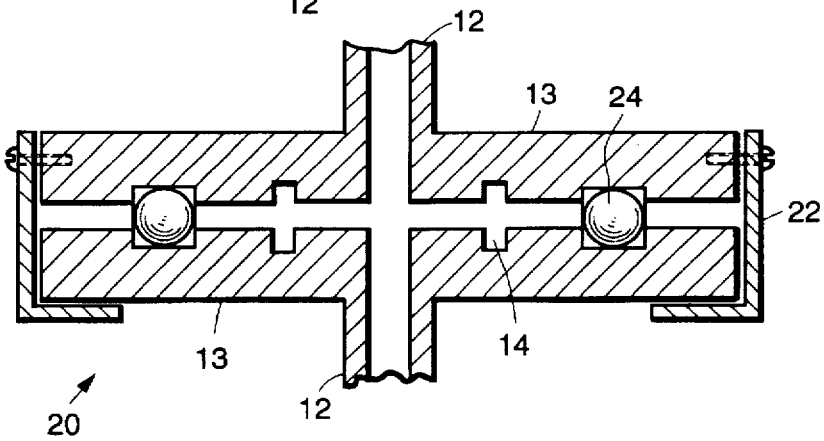
FIG. 6 shows a spacer system comprising a radial or thrust ball bearing press-fit between adjacent planar surfaces of two waveguide flanges and a ring bracket.

FIG. 6 illustrates a portion of the joint 10 showing the two waveguides 12 and the RF choke 14 (grooves 14), and which has a spacer system 20 comprising a radial or thrust ball bearing 24 press-fit between adjacent planar surfaces of the two waveguide flanges 13, and the ring bracket 22. The ring bracket is attached to one of the planar waveguide flanges 13 to keep it from moving while the other waveguide flange 13 is free to rotate.

Figure 7:
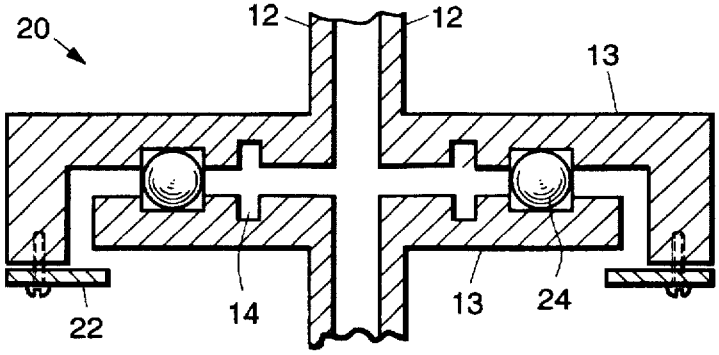
FIG. 7 shows a radial or thrust ball bearing press-fit between adjacent planar surfaces of two waveguide flanges and a ring bracket.

FIG. 7 illustrates a portion of the joint 10 showing the two waveguides 12 and the RF choke 14 (grooves 14), and which has a spacer system 20 wherein the radial or thrust ball bearing 24 is press-fit between the adjacent planar surfaces of the two waveguide flanges 13, and the ring bracket 22. The ring bracket is attached to one of the planar waveguide flanges 13 to keep it from moving while the other waveguide flange 13 is free to rotate. The waveguide flange 13 to which the ring bracket 22 is attached is L-shaped.

Figure 8:
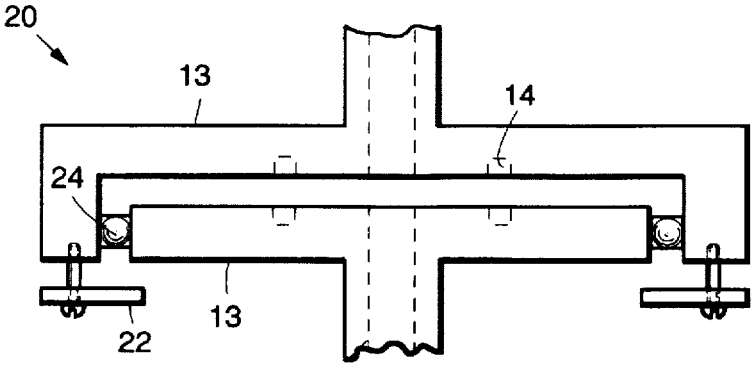
FIG. 8 shows a spacer system comprising a ring bracket and a radial or thrust ball bearing, wherein the ball bearing is disposed between lateral edges of an L-shaped waveguide flange and another planar waveguide flange.

FIG. 8 illustrates a portion of the joint 10 showing the two waveguides 12 and the RF choke 14 (grooves 14), and which has a spacer system 20 comprising the ring bracket 22 and the radial or thrust ball bearing 24, wherein the ball bearing 24 is disposed between lateral edges of an L-shaped waveguide flange 13 and the other planar waveguide flange 13. The ring bracket is attached the L-shaped planar waveguide flange 13 to keep it from moving while the other waveguide flange 13 is free to rotate.

With the waveguides 12 aligned (zero rotation), transmission from one waveguide 12 to the other is nearly ideal (VSWR<1.03:1, insertion loss<0.1 dB) at X-band. Rotating one waveguide 12 with respect to the other introduces a near consinusoidal multiplier to the inter-waveguide coupling (i.e. transmission is affected very little at rotation angles near 0 degrees, transmission almost totally inhibited at 90 degree rotation). The maximum useable rotation angle range is therefore dependent on the maximum tolerable loss level for a specific application. To achieve rotation angles near 90 degrees while still incurring low losses, a plurality of joints 10 may be cascaded (i.e. several joints 10 may be placed in series between waveguides as shown in FIG. 2. Cascaded joints 10 may be rotated in unison through use of a gear system or similar device (not shown).

Figure 9A:
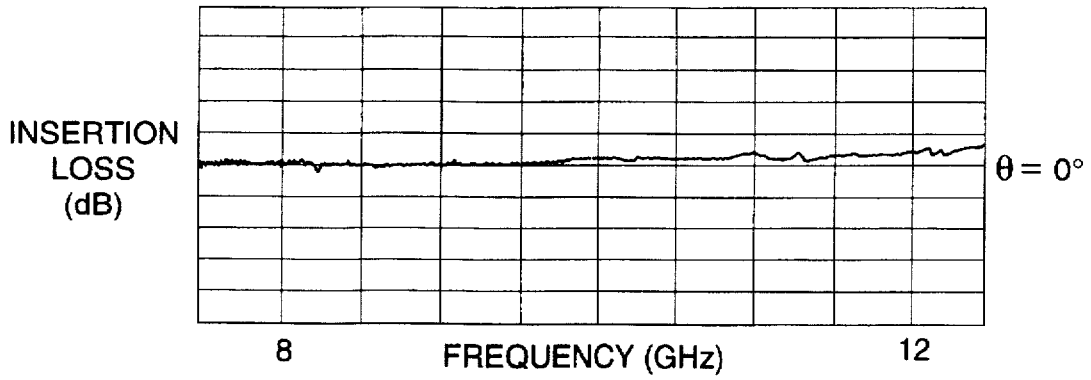
FIGS. 9A, 9B, and 9C illustrate measured insertion loss through the joint at rotation angles of 0, +/−30, and +/−45 degrees, respectively.
Figure 9B:
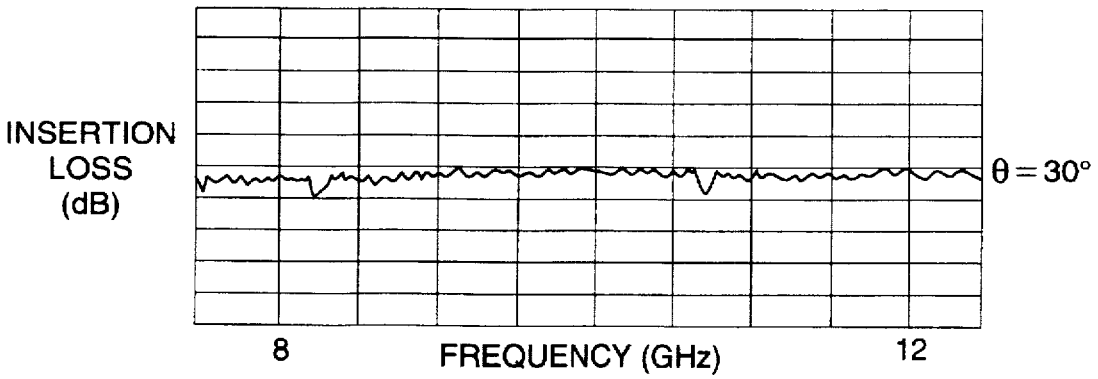
Figure 9C:
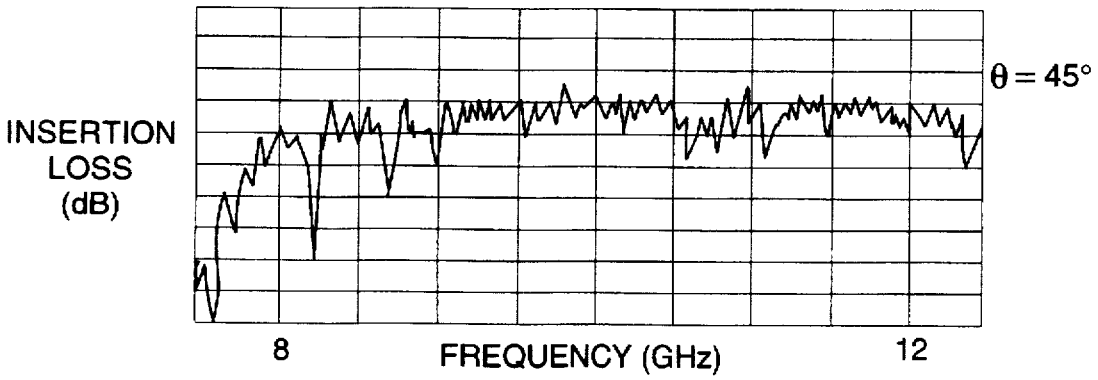

As an initial reduction to practice of the low-cost rotary joint 10, two rectangular waveguides were butted together to form a test rotary joint 10. The waveguides were rotated with respect to each other and VSWR and loss measurements were recorded. The separation between the waveguides was also varied. The tests were performed at X-band (8–12 Ghz). FIGS. 9A, 9B, and 9C illustrate measured insertion loss through the joint 10 at rotation angles of 0, +/−30, and +/45 degrees, respectively. FIGS. 9A and 9B show that the measured insertion loss (0.5 dB per division) through the joint 10 is substantially constant between 8 and 12 Ghz. At rotation angles of 0 and 30 degrees, the insertion loss varies less than about 0.5 dB. FIG. 9C shows that the measured insertion loss (0.2 dB per division) through the joint 10 is also substantially constant between 8 and 12 Ghz. At a rotation angle of 45 degrees, the insertion loss varies no more that about 0.6 dB.

Figure 10A:
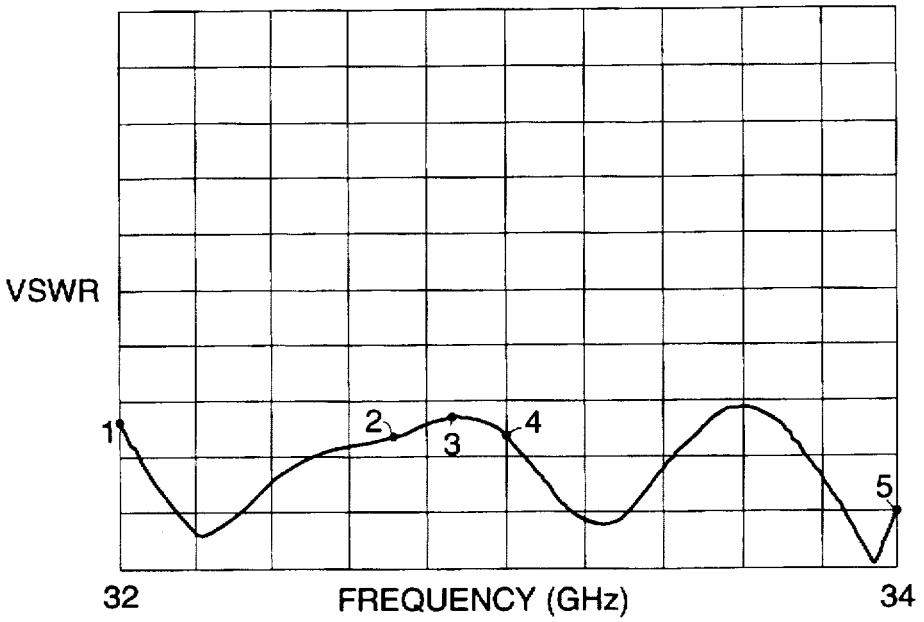
FIGS. 10A and 10B illustrate measured voltage standing wave ratio (VSWR) for a reduced to practice Ka-band joint, over a frequency range if 32 to 34 Ghz, at rotation angles of 0 and 30 degrees, respectively.
Figure 10B:
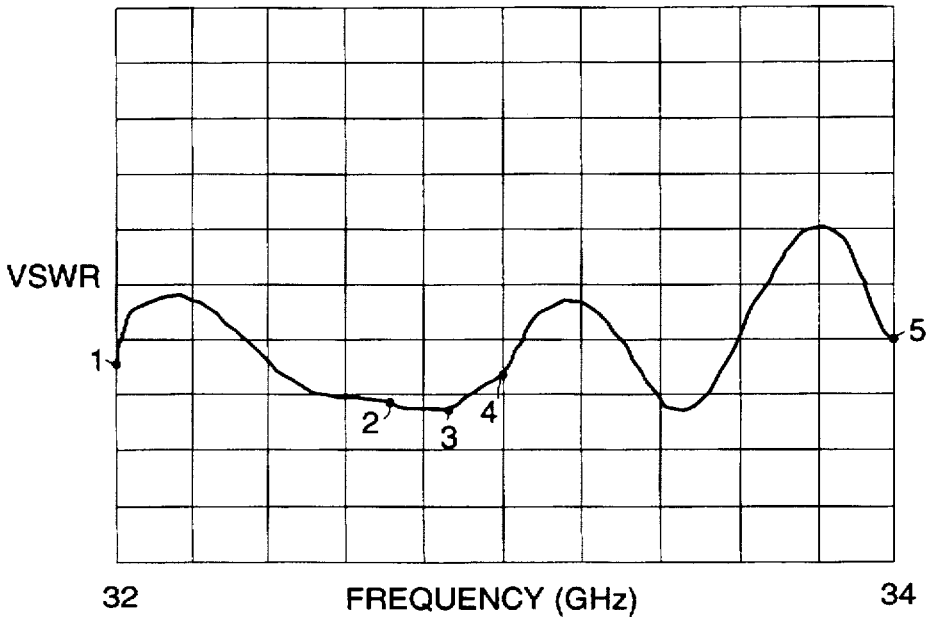

A more refined reduction to practice was accomplished at Ka-band using the specific geometry illustrated in FIGS. 3 and 4. An annular choke groove having a 0.086" depth and 0.0255" width was used. A constant air gap of 0.010" was maintained by the refined joint 10. FIGS. 10A and 10B illustrate the measured voltage standing wave ratio (VSWR) for the refined reduced to practice Ka-band joint 10, over a frequency range if 32 to 34 Ghz, at rotation angles of 0 and 30 degrees respectively. In FIGS. 10*a* and 10*b*, there are five markers shown (labeled 1–5). In FIG. 10*a*, the markers correspond to a VSWR of 1.1375 at 32 Ghz, a VSWR of 1.1243 at 32.7 Ghz, a VSWR of 1.1389 at 32.85 Ghz, a VSWR of 1.1223 at 33 Ghz, and a VSWR of 1.0576 at 34 Ghz, respectively. In FIG. 10*b*, the markers correspond to a VSWR of 1.1669 at 32 Ghz, a VSWR of 1.139 at 32.7 Ghz, a VSWR of 1.1348 at 32.85 Ghz, a VSWR of 1.1756 at 33 Ghz, and a VSWR of 1.2059 at 34 Ghz, respectively.

Thus there has been described a new and improved rectangular waveguide rotary joint. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A rectangular waveguide rotary joint comprising:

a first rectangular wavequides having a first waveguide flange which is L-shaped;

second rectangular waveguide having a second waveguide flange, wherein the second waveguide flange is disposed adjacent to the first waveguide flange with an air gap disposed therebetween and wherein the first and second waveguide flanges have adjacent planar surfaces;

RF chokes disposed in the respective waveguide flanges for reducing RF leakage caused by the air gap; and a low friction spacer system for separating the first and second waveguides to maintain relative alignment of the waveguides during axial rotation of the waveguides relative to each other and maintain a substantially constant separation between the waveguides, said spacer system comprising means for securing the first waveguide flange and rotational means that permits the second waveguide flange to rotate relative to the first waveguide flange, comprising a ball bearing disposed between lateral edges of the L-shaped first waveguide flange and the second planar waveguide flange, and a ring bracket attached to the L-shaped first planar waveguide flange to keep the L-shaped first planar waveguide flange from moving while the second waveguide flange is free to rotate relative to the L-shaped first waveguide flange.

2. A rectangular waveguide rotary joint comprising:

a first rectangular waveguide having a first waveguide flange which is L-shaped;

a second rectangular waveguide having a second waveguide flange, wherein the second waveguide flange is disposed adjacent to the first waveguide flange with an air gap disposed therebetween and wherein the first and second waveguide flanges have adjacent planar surfaces:

RF chokes disposed in the respective waveguide flanges for reducing RF leakage caused by the air gap; and a low friction spacer system for separating the first and second waveguides to maintain relative alignment of the waveguides during axial rotation of the waveguides relative to each other and maintain a substantially constant separation between the waveguides, said spacer system comprising means for securing the first waveguide flange and rotational means that permits the second waveguide flange to rotate relative to the first waveguide flange, comprising a ball bearing press-fit between the adjacent planar surfaces of the first and second waveguide flanges, and a ring bracket attached to the L-shaped first waveguide flange to keep the first planar waveguide flange from moving while the second waveguide flange is free to rotate relative to the first waveguide flange.

3. A rectangular waveguide rotary joint comprising:

a first rectangular waveguide having a first waveguide flange;

a second rectangular waveguide having a second waveguide flange, wherein the second waveguide flange is disposed adjacent to the first waveguide flange with an air gap disposed therebetween and wherein the first and second waveguide flanges have adjacent planar surfaces;

RF chokes disposed in the respective waveguide flanges for reducing RF leakage caused by the air gap; and a low friction spacer system for separating the first and second waveguides to maintain relative alignment of the waveguides during axial rotation of the waveguides relative to each other and maintain a substantially constant separation between the waveguides, said spacer system comprising means for securing the first waveguide flange and rotational means that permits the second waveguide flange to rotate relative to the first waveguide flange, comprising a ball bearing press-fit between the adjacent planar surfaces of the first and second waveguide flanges, and a ring bracket attached to the first planar waveguide flange to keep the first planar waveguide flange from moving while the second waveguide flange is free to rotate relative to the first waveguide flange.

4. A rectangular waveguide rotary joint comprising:

a first rectangular waveguide having a first waveguide flange;

a second rectangular waveguide having a second waveguide flange, wherein the second waveguide flange is disposed adjacent to the first waveguide flange with an air gap disposed therebetween and wherein the first and second waveguide flanges have adjacent planar surfaces;

RF chokes disposed in the respective waveguide flanges for reducing RF leakage caused by the air gap; and a low friction spacer system for separating the first and second waveguides to maintain relative alignment of the waveguides during axial rotation of the waveguides relative to each other and maintain a substantially constant separation between the waveguides, said spacer system comprising means for securing the first waveguide flange and rotational means that permits the second waveguide flange to rotate relative to the first waveguide flange, comprising a substantially frictionless insert ring and a ring bracket that is attached to the first planar waveguide flange to keep the first planar waveguide flange from moving an while the second planar waveguide flange is free to rotate relative to the first waveguide flange, and wherein the insert ring is disposed between the adjacent planar surfaces of the first and second waveguide flanges.

* * * * *